US006921291B2

(12) United States Patent
Shih

(10) Patent No.: US 6,921,291 B2
(45) Date of Patent: Jul. 26, 2005

(54) TRIPLICATE EARPHONE SOCKET

(76) Inventor: Helen Shih, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/600,326

(22) Filed: Jun. 23, 2003

(65) Prior Publication Data

US 2004/0259414 A1 Dec. 23, 2004

(51) Int. Cl.[7] ..... H01R 13/60
(52) U.S. Cl. ..... 439/541.5; 439/101
(58) Field of Search ..... 439/541.5, 188, 439/668, 79, 108, 101, 607

(56) References Cited

U.S. PATENT DOCUMENTS 6,234,833 B1 * 5/2001 Tsai et al. ..... 439/541.5
6,234,834 B1 * 5/2001 Tsai et al. ..... 439/541.5
6,524,130 B1 * 2/2003 Yeh ..... 439/541.5
6,540,551 B1 * 4/2003 Wang ..... 439/541.5
6,666,716 B2 * 12/2003 Chien-Chung ..... 439/541.5
6,688,913 B2 * 2/2004 Li ..... 439/541.5

* cited by examiner

*Primary Examiner*—Gary Paumen

(57) ABSTRACT

A triplicate earphone socket includes an L-shaped base comprising a plastic core having three sound sockets. Each of the sound sockets is provided with a plastic housing at a front end thereof, and first, second, third, fourth and fifth sockets at an interior thereof. The first, second, third, fourth and fifth sockets are placed with a first terminal assembly, a second assembly, a ground terminal assembly, a fourth terminal assembly and a fifth terminal assembly in a downward direction, respectively. The L-shaped base and the plastic core are also enveloped by a metal housing. According to the aforesaid structure, for that the plastic housing and the three sound sockets are a formed integral, structure thereof is simplified for lowering production expenses and elevating market competitiveness.

1 Claim, 8 Drawing Sheets

TRIPLICATE EARPHONE SOCKET

BACKGROUND OF THE INVENTION (a) Field of the Invention

The invention relates to a triplicate earphone socket, and more particularly, to an earphone socket comprising a plastic base further having three sound sockets as an integral with the plastic base, thereby simplifying structure thereof for facilitating assembly, lowering production cost and elevating market competitiveness.

(b) Description of the Prior Art

Common connectors disposed at a computer motherboard are usually independently arranged. However, due to more diverse functional requirements of existing motherboards, interface cards such as video graphic array cards, sound cards, and printer ports formerly externally added are now built-in at the motherboards. Yet, areas of these motherboards remain unchanged, or are even becoming smaller, and hence usable areas on the motherboards are also getting smaller. To directly dispose connectors of a same type on a motherboard, the connectors cannot be tightly arranged next to one another and thus the connectors are inevitably reserved with spaces in between; these spaces occupy a certain area of the motherboard. In addition, each of adjacent sides of two adjacent connectors has a side wall, meaning that an extra thickness made up by the side wall is further occupied when arranging the two connectors next to each other, and subsequently occupying more space. To be conclusive, excessive spaces are occupied as a whole.

Suppose two connectors are arranged side by side on a motherboard in two separate steps, it is certain that assemblies thereof become more complicated. Manufacturing speed is slowed down and overall production expenses are therefore relatively increased.

There is another assembly method for connectors. Connectors of a same type are stacked on one another, and are then mounted to a motherboard. Using the stacking method, an area of the motherboard occupied by the connectors is indeed reduced. However, structures of the connectors being mounted by the stacking method are more complex for that it is necessary that adjacent upper and lower connectors have structures for wedging and fastening. Also, these connectors can only be manufactured by additional molds pre-made, and are then assembled after completing manufacturing thereof. Production cost is similarly increased as well as raising complications and inconveniences in assembly thereof, and thus multiplying overall production expenses and lowering market competitiveness.

SUMMARY OF THE INVENTION

In the view of the aforesaid shortcomings of prior connectors using the stacking method, the object of the invention is to provide an earphone socket comprising a core having three sound sockets that are a formed integral with the plastic housing, thereby simplifying structure thereof for facilitating assembly, lowering production cost and elevating market competitiveness.

The triplicate earphone socket according to the invention comprises an L-shaped base disposed with a plastic core having three earphone sockets. Each of the sound sockets is provided with a plastic ring at a front end thereof, and first, second, third, fourth and fifth sockets at an interior thereof. The first, second, third, fourth and fifth sockets are placed with a first terminal assembly, a second assembly, a ground terminal assembly, a fourth terminal assembly and a fifth terminal assembly in a downward direction, respectively. In addition, the L-shaped base and the plastic core are enveloped by a metal housing. According to the aforesaid structure, for that the plastic housing and the three sound sockets are a formed integral, structure thereof is simplified for lowering production expenses and elevating market competitiveness.

DETAILED DESCRIPTION OF THE PREFERRED EMBODIMENTS

To better understand the invention, detailed descriptions shall be given with the accompanying drawings hereunder.

Figure 1:
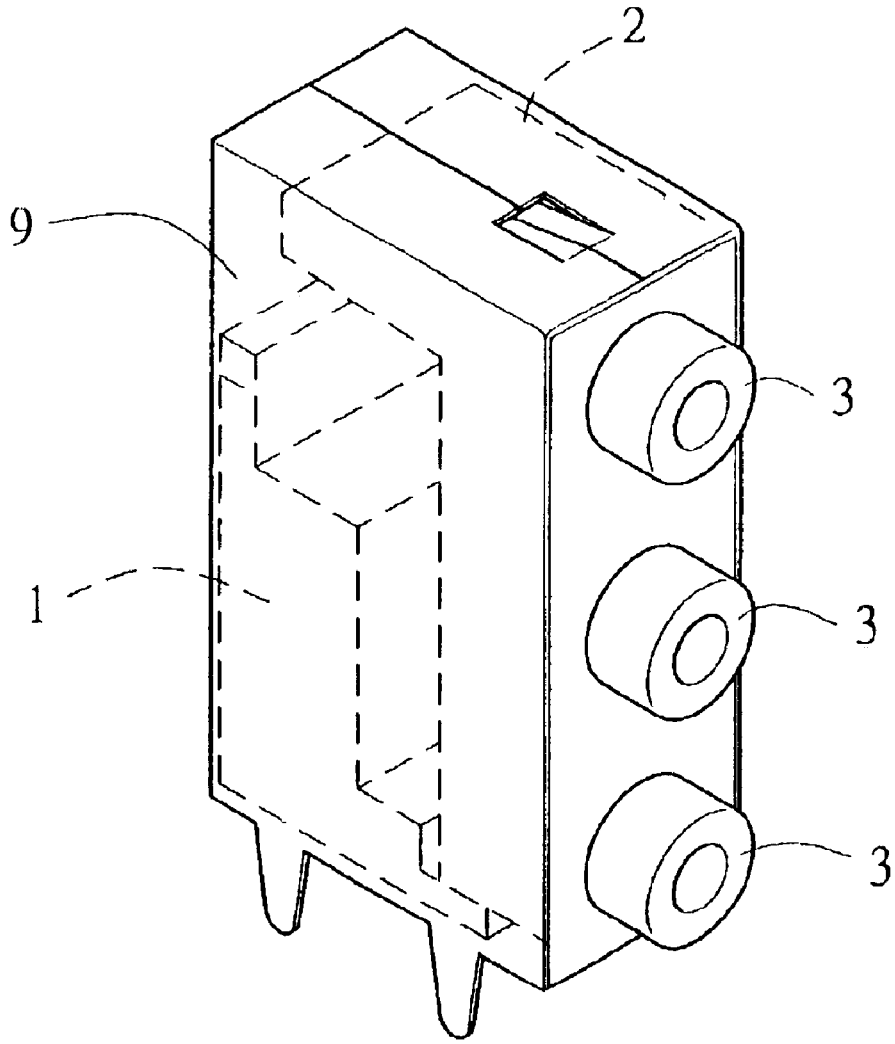
FIG. 1 shows an elevational view according to the invention.
Figure 2:
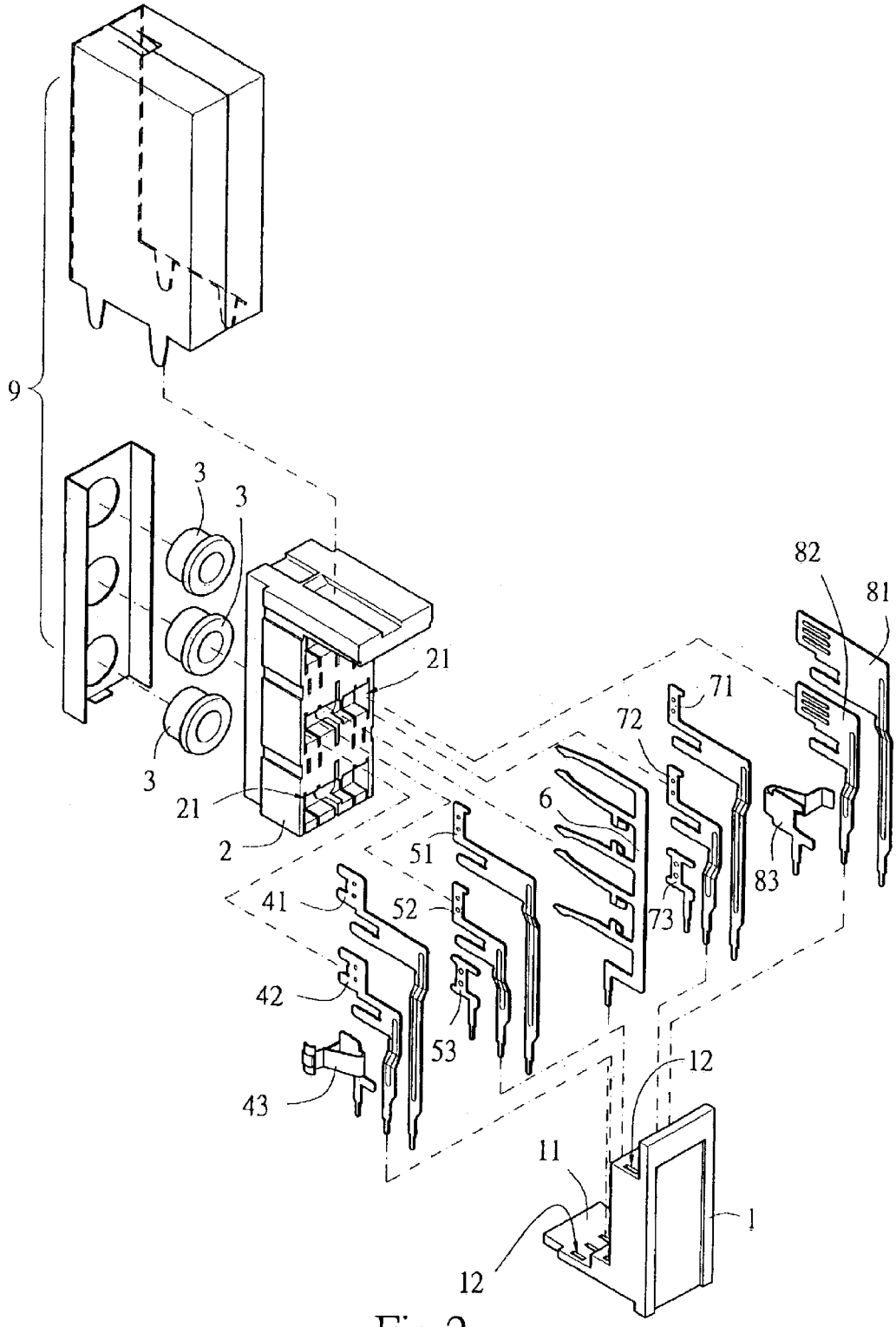
FIG. 2 shows an exploded elevational view according to the invention.
Figure 4:
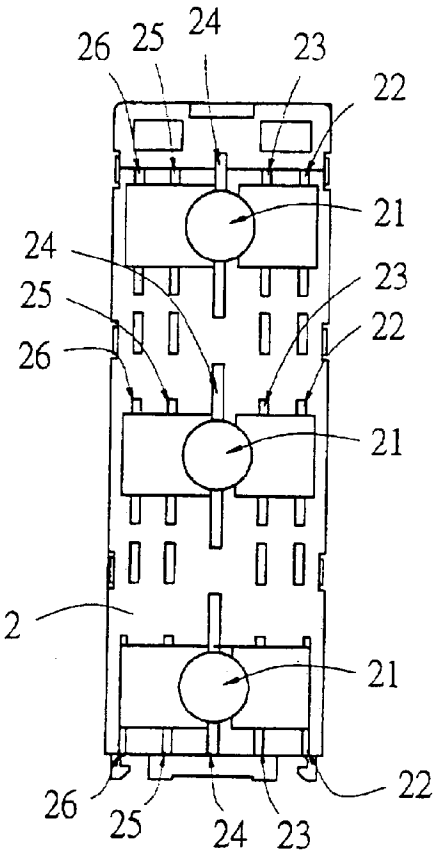
FIG. 4 shows a rear view of the plastic core according to the invention.
Figure 3:
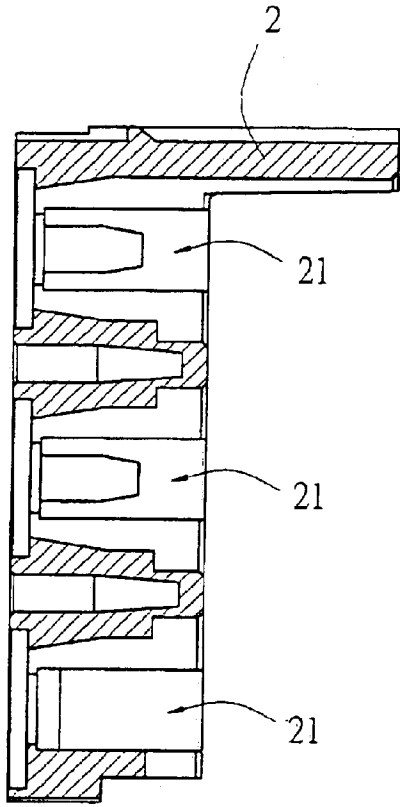
FIG. 3 shows a sectional view of the plastic core according to the invention.
Figure 5:
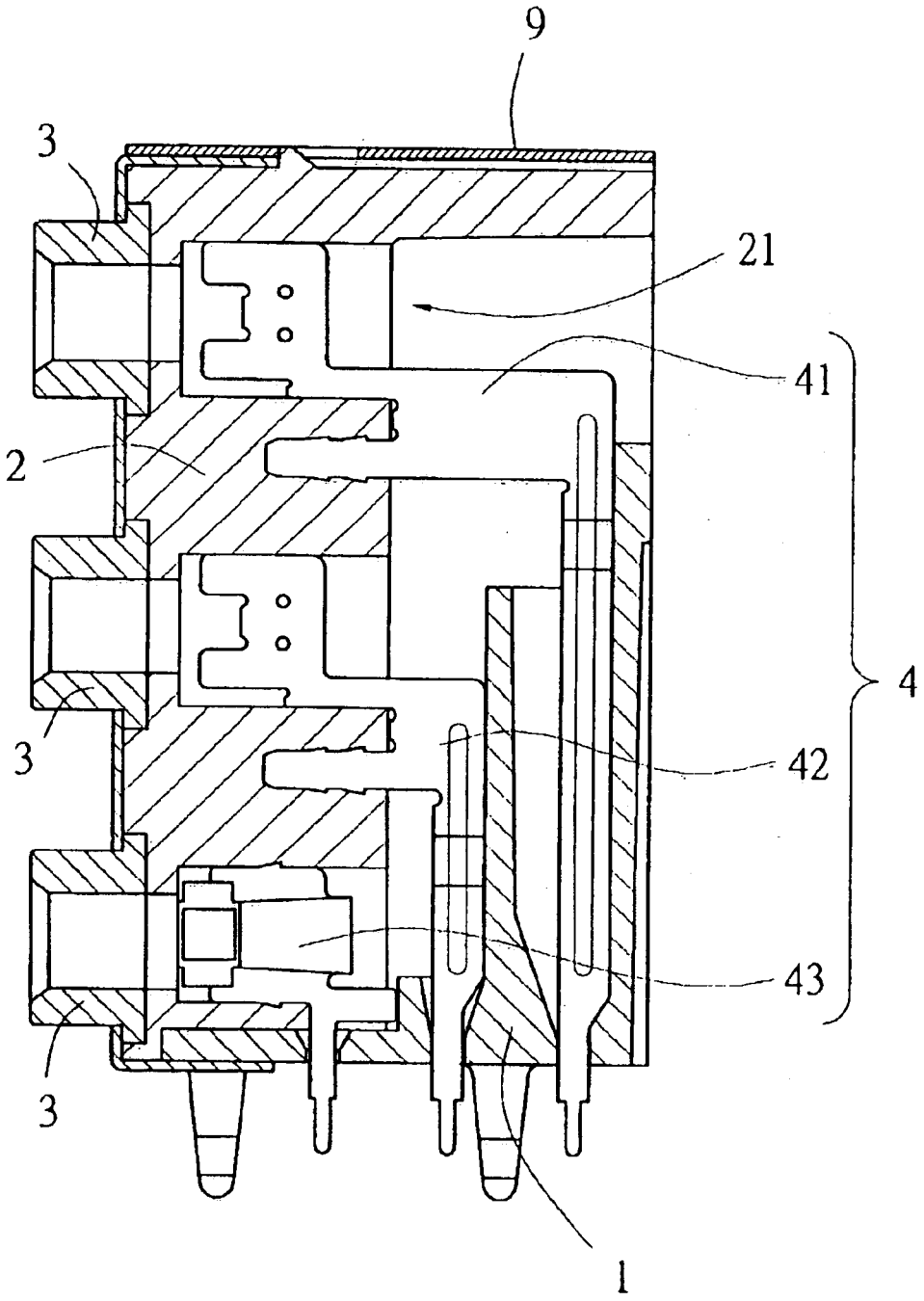
FIG. 5 shows a sectional view illustrating the first socket inserted with the first terminal assembly according to the invention.
Figure 6:
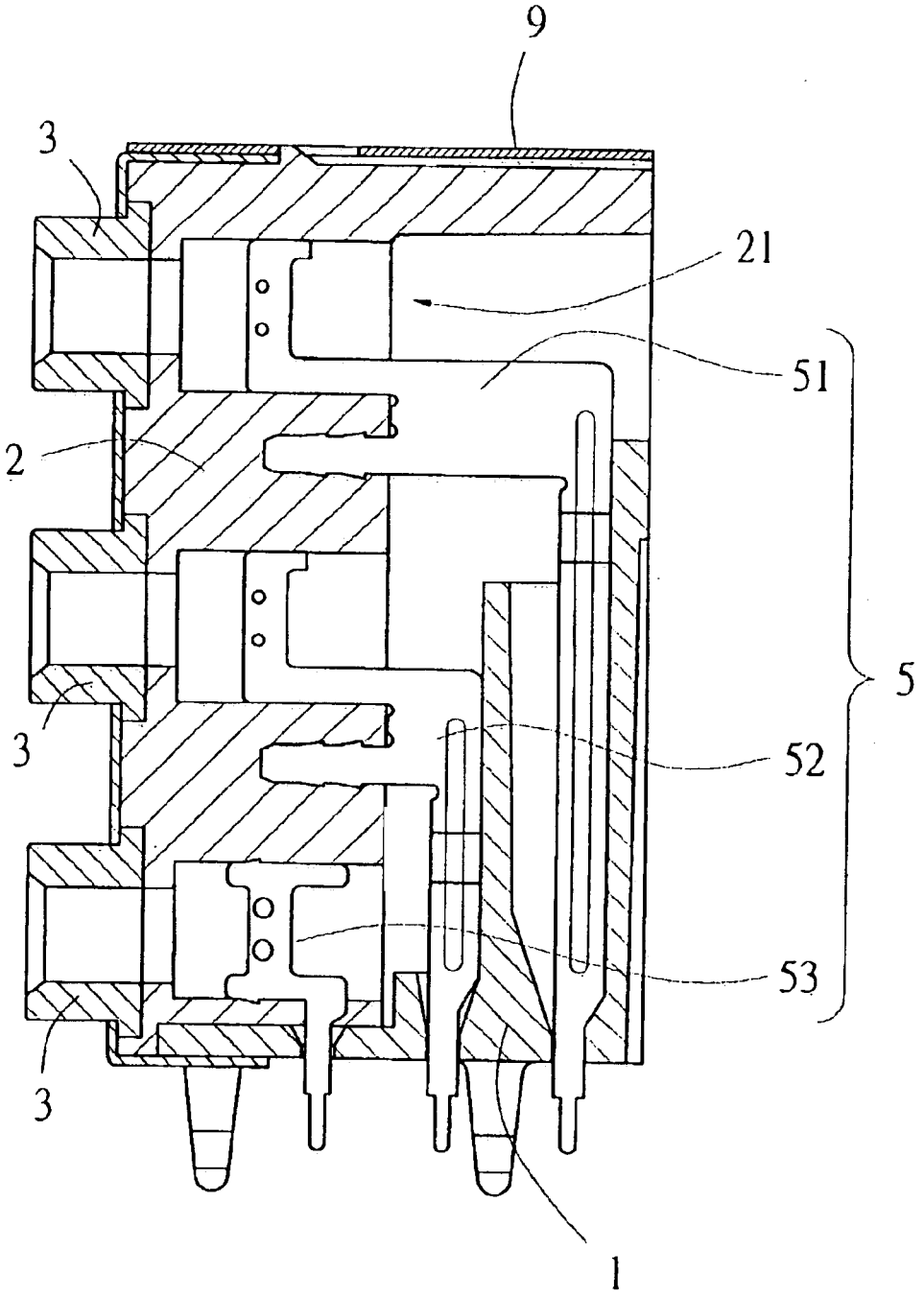
FIG. 6 shows a sectional view illustrating the second socket inserted with the second terminal assembly according to the invention.
Figure 7:
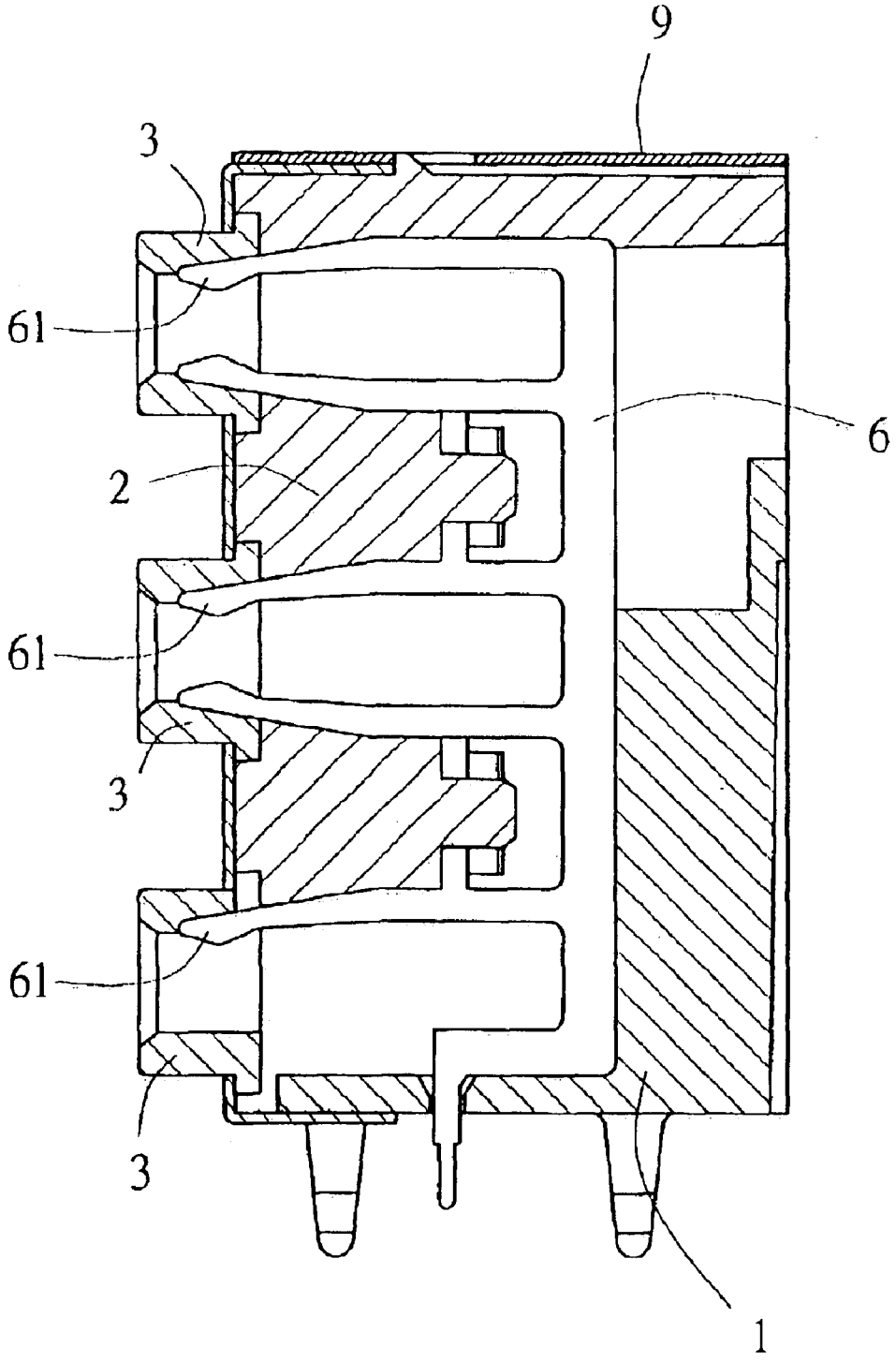
FIG. 7 shows a sectional view illustrating the third socket inserted with the ground terminal assembly according to the invention.
Figure 8:
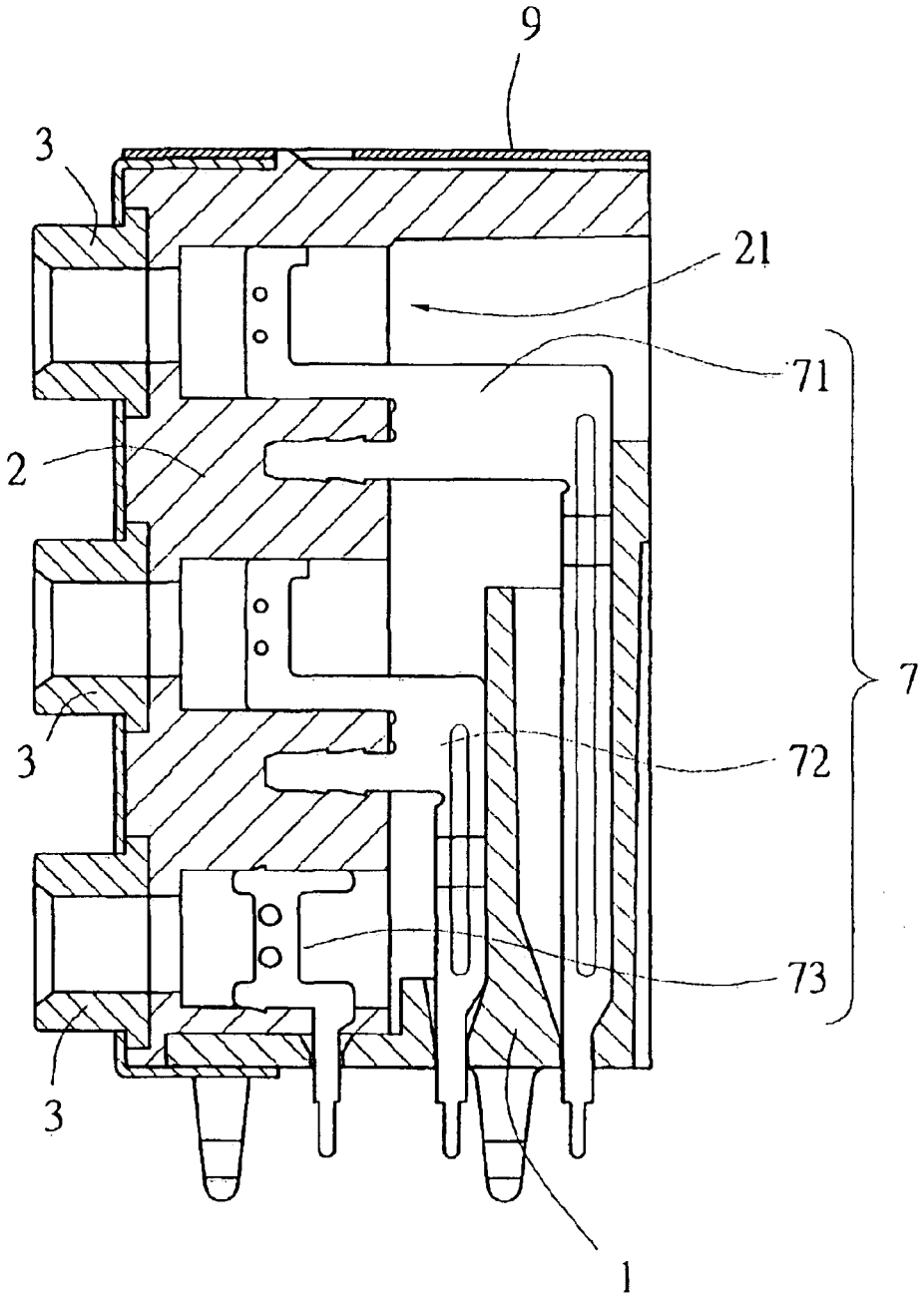
FIG. 8 shows a sectional view illustrating the fourth socket inserted with the third terminal assembly according to the invention.
Figure 9:
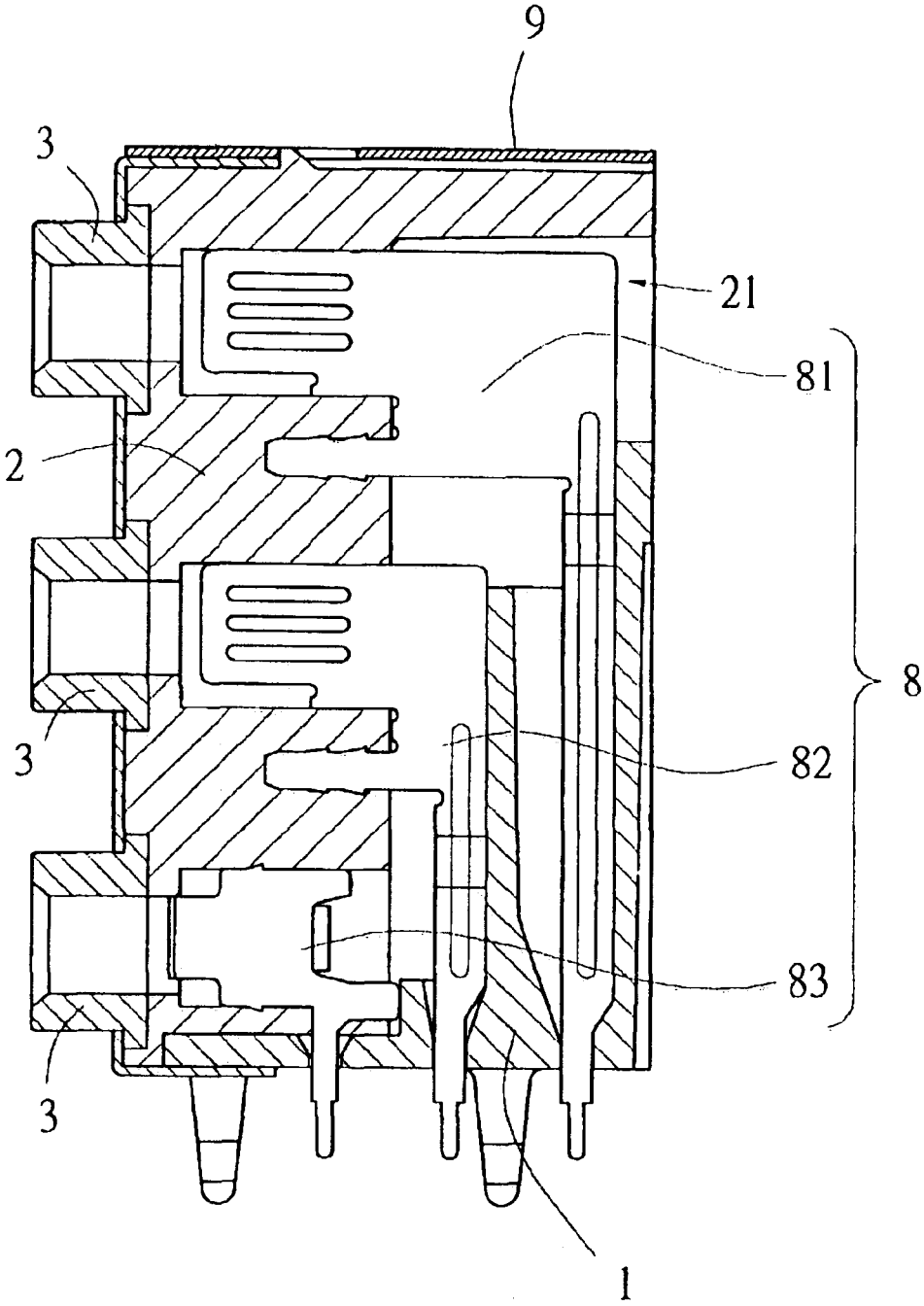
FIG. 9 shows a sectional view illustrating the fifth socket inserted with the fourth terminal assembly according to the invention.

Referring to FIGS. 1 and 2, the invention comprises an L-shaped base 1, a plastic core 2, plastic rings 3, a first terminal assembly 4, a second terminal assembly 5, a ground terminal assembly 6, a third terminal assembly 7, a fourth terminal assembly 8 and a metal housing 9. Illustrations of relative positions and structures of the various members are:

the L-shaped base 1 has a horizontal portion 11 disposed with a plurality of openings 12;

the plastic core 2 is mounted on the L-shaped base 1, and is provided with three sound sockets 21 in an upward direction; wherein each of the sound sockets 21 is longitudinally disposed with a first socket 22, a second socket 23, a third socket 24, a fourth socket 25 and a fifth socket 26 as shown in FIGS. 3 and 4;

each of the plastic rings 3 is disposed at a front end of each of the sound sockets 21 at the plastic core 2;

the first terminal assembly 4 is consisted of a first upper terminal 41, a second middle terminal 42 and a first lower terminal 43; wherein the first upper terminal 41, the second middle terminal 42 and the first lower terminal 43 are placed in the first sockets 22 of the three sound sockets 21 at the plastic core 2, and bottom portions of the first upper terminal 41, the second middle terminal 42 and the first lower terminal 43 are penetrated through the openings 12 at the horizontal portion 11 of the L-shaped base 1;

the second terminal assembly 5 is consisted of a second upper terminal 51, a second middle terminal 52 and a second lower terminal 53;

wherein the second upper terminal 51, the second middle terminal 52 and the second lower terminal 53 are placed in the second sockets 23 of the three sound sockets 21 at the plastic core 2, and bottom portions of the second upper terminal 51, the second middle terminal 52 and the second lower terminal 53 are penetrated through the openings 12 at the horizontal portion 11 of the L-shaped base 1;

the ground terminal assembly 6 is a slice-shaped body, and is provided with three sub-terminals 61 placed in the third sockets 24 of the three sound sockets 21, respectively;

the third terminal assembly 7 is consisted of a third upper terminal 71, a third middle terminal 72 and a third lower terminal 73; wherein the third upper terminal 71, the third middle terminal 72 and the third lower terminal 73 are placed in the fourth sockets 25 of the three sound sockets 21 at the plastic core 2, and bottom portions of the third upper terminal 71, the third middle terminal 72 and the third lower terminal 73 are penetrated through the openings 12 at the horizontal portion 11 of the L-shaped base 1;

the fourth terminal assembly 8 is consisted of a fourth upper terminal 81, a fourth middle terminal 82 and a fourth lower terminal 83; wherein the fourth upper terminal 81, the fourth middle terminal 82 and the fourth lower terminal 83 are placed in the fifth sockets 26 of the three sound sockets 21 at the plastic core 2, and bottom portions of the fourth upper terminal 81, the fourth middle terminal 82 and the fourth lower terminal 83 are penetrated through the openings 12 at the horizontal portion 11 of the L-shaped base 1; and the metal housing 9 is a rectangular housing enveloping around the L-shaped base 1 and the plastic core 2.

According the aforesaid structure, the plastic housing 2 has three sound sockets 21 that are a formed integral with the plastic housing 2. The first sockets 22, the second sockets 23, the third sockets 24, the fourth sockets 25 and the fifth sockets 26 of the sound sockets 21 are inserted with the first terminal assembly 4, the second terminal assembly 5, the ground terminal assembly 6, the third terminal assembly 7 and the fourth terminal assembly 8. The first upper terminal 41, the first middle terminal 42 and the first lower terminal 43 of the first terminal assembly 4 are placed in the first sockets 22 of the three sound sockets 21 in a downward direction. The second upper terminal 51, the second middle terminal 52 and the second lower terminal 53 of the second terminal assembly 5 are placed in the second sockets 23 of the three sound sockets 21 in a downward direction. The three sub-terminals 61 of the ground terminal assembly 6 are similarly placed in the third sockets 24 of the three sound sockets 21 in a downward direction. The third upper terminal 71, the third middle terminal 72 and the third lower terminal 73 of the third terminal assembly 5 are placed in the fourth sockets 24 of the three sound sockets 21 in a downward direction. The fourth upper terminal 81, the fourth middle terminal 82 and the fourth lower terminal 83 of the fourth terminal assembly 6 are placed in the fifth sockets 25 of the three sound sockets 21 in a downward direction. The metal housing 9 is enveloped around the L-shaped base 1 and the plastic core 2. Finally an earphone socket having three sound sockets is completed.

For that the core 2 is provided with three sound sockets 21 as an integral, complications and inconveniences of assembly of the aforesaid stacking method are eliminated. Furthermore, the terminal assemblies are all inserted in the sound sockets 21 of the plastic core 2, and therefore assembly is facilitated for lowering production cost and elevating market competitiveness as a whole.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A triplicate earphone socket comprising:

an L-shaped base having a horizontal portion disposed with a plurality of openings;

a plastic core mounted on the L-shaped base, and provided with three sound sockets in an upward direction; wherein each of the sound sockets is longitudinally disposed with a first socket, a second socket, a third socket, a fourth socket and a fifth socket;

a plastic ring being disposed at a front end of each of the sound sockets at the plastic core;

a first terminal assembly consisted of a first upper terminal, a second middle terminal and a first lower terminal; wherein the first upper terminal, the second middle terminal and the first lower terminal are placed in the first sockets of the three sound sockets at the plastic core, and bottom portions of the first upper terminal, the second middle terminal and the first lower terminal being penetrated by the openings at the horizontal portion of the L-shaped base;

a second terminal assembly consisted of a second upper terminal, a second middle terminal and a second lower terminal; wherein the second upper terminal, the second middle terminal and the second lower terminal are placed in the second sockets of the three sound sockets at the plastic core, and bottom portions of the second upper terminal, the second middle terminal and the second lower terminal being penetrated by the openings at the horizontal portion of the L-shaped base;

a ground terminal assembly being in a slice-shaped body, and provided with three sub-terminals placed in the third sockets of the three sound sockets, respectively;

a third terminal assembly consisted of a third upper terminal, a third middle terminal and a third lower terminal; wherein the third upper terminal, the third middle terminal and the third lower terminal are placed in the fourth sockets of the three sound sockets at the plastic core, and bottom portions of the third upper terminal, the third middle terminal and the third lower terminal being penetrated by the openings at the horizontal portion of the L-shaped base;

a fourth terminal assembly consisted of a fourth upper terminal, a fourth middle terminal and a fourth lower terminal; wherein the fourth upper terminal, the fourth middle terminal and the fourth lower terminal are placed in the fifth sockets of the three sound sockets at the plastic core, and bottom portions of the fourth upper terminal, the fourth middle terminal and the fourth lower terminal being penetrated by the openings at the horizontal portion of the L-shaped base; and a metal housing being in shape of a rectangular housing enveloping around the L-shaped base and the plastic core.

* * * * *